US007440816B1

(12) United States Patent
He et al.

(10) Patent No.: US 7,440,816 B1
(45) Date of Patent: Oct. 21, 2008

(54) APPARATUS AND METHODS FOR AUTOMATIC DISPOSABLE SHOE COVER DISPENSE

(76) Inventors: Liam Minhai He, 377 Westford Rd., Tyngsboro, MA (US) 01879-2416; Qiuhong Wang, 377 Westford Rd., Tyngsboro, MA (US) 01879-2416

( * ) Notice: Subject to any disclaimer, the term of this patent is extended or adjusted under 35 U.S.C. 154(b) by 8 days.

(21) Appl. No.: 11/784,786

(22) Filed: Apr. 10, 2007

Related U.S. Application Data

(60) Provisional application No. 60/795,286, filed on Apr. 27, 2006.

(51) Int. Cl.
*G06F 17/00* (2006.01)

(52) U.S. Cl. ..... 700/231; 700/232; 221/9; 221/13; 223/111

(58) Field of Classification Search ..... 700/231–244; 221/111; 223/111
See application file for complete search history.

(56) References Cited

U.S. PATENT DOCUMENTS

| | | | | |
|---|---|---|---|---|
| 3,775,793 | A * | 12/1973 | Casavant et al. | 12/1 R |
| 6,543,075 | B2 * | 4/2003 | Gultekin et al. | 12/1 R |
| 2006/0144879 | A1 * | 7/2006 | Hu | 223/111 |
| 2007/0163912 | A1 * | 7/2007 | Chen | 206/477 |
| 2007/0204568 | A1 * | 9/2007 | Chen | 53/459 |

OTHER PUBLICATIONS

"Shoe Cover Dispenser" shenzhen Sikerma technology Co., Ltd http://www.fuzing.com/vli/002127472264/shoe-cover-dispenser.*

* cited by examiner

*Primary Examiner*—Gene Crawford
*Assistant Examiner*—Michael K Collins

(57) ABSTRACT

Protective shoe covers have been widely used in health care settings and some manufacturing environments such as semiconductor and pharmaceutical industries. An automatic system that dispenses shoe covers to user's feet is disclosed. The system includes the micro control unit, the embedded software and the control algorithm, the electro-mechanical operational apparatus and physical and biophysical sensors. The methods that perform shoe cover fetching, stretching, extension and deployment are also presented in this application.

13 Claims, 12 Drawing Sheets

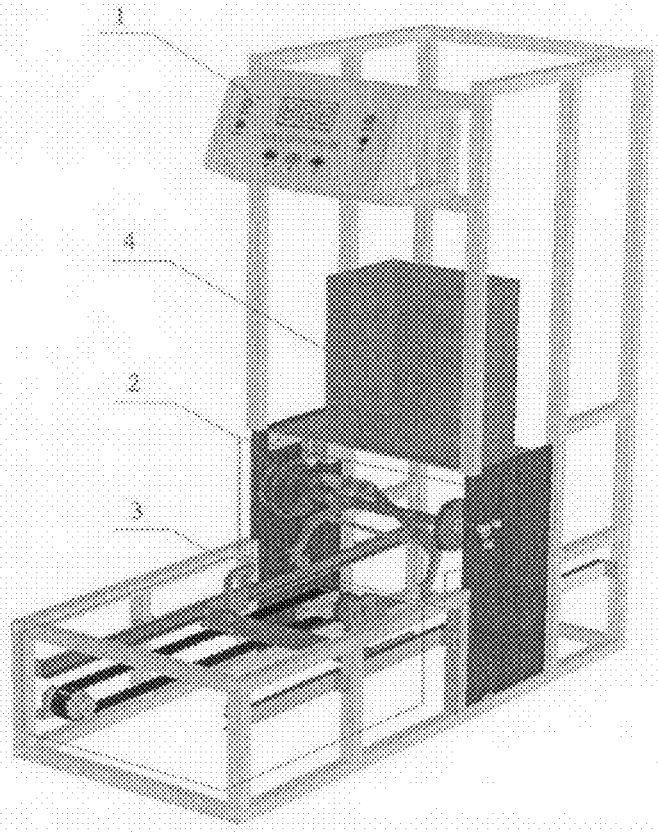
Figure 1a
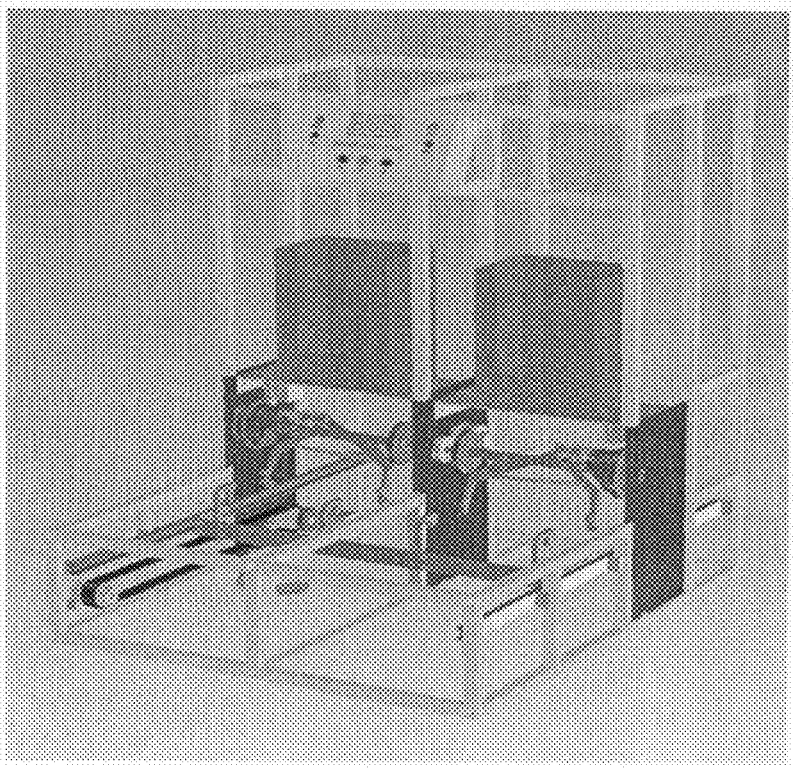
Figure 1b
Figure 1

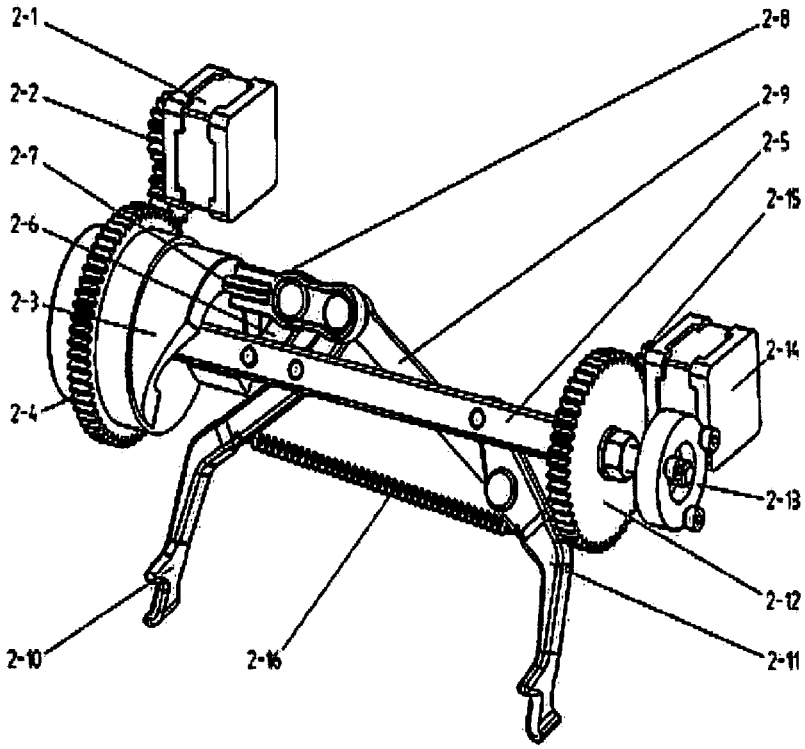

Figure 4

| | |
|---|---|
| 2-1 | Shoe Cover Stretching Step Motor |
| 2-2 | Gear on Shoe Cover Stretching Step Motor |
| 2-3 | Circular pitch type Cam 2-3 |
| 2-4 | Gear on the Cam 2-3 |
| 2-5 | Rotation Rod |
| 2-6 | Short connecting rod |
| 2-7 | Rotating wheel |
| 2-8 | Rotating wheel holder |
| 2-9 | Long connecting rod |
| 2-10 | The left fetching arm |
| 2-11 | The right fetching arm |
| 2-12 | The rotating axial gear |
| 2-13 | The rotating axial place |
| 2-14 | The rotating step motor |
| 2-15 | The end gear of the rotating step motor |
| 2-16 | The fetching arm spring |

| | |
|---|---|
| 2-5 | Rotating axial |
| 2-6 | The short connecting rod |
| 2-7 | Rotating wheel |
| 2-8 | Rotating wheel holder |
| 2-9 | The long connecting rod |
| 2-10 | The left fetching arm |
| 2-11 | The right fetching arm |
| 2-12 | The rotating axial gear |
| 2-13 | The rotating axial place |
| 2-14 | The fetching step motor |
| 2-15 | The gear (end axis) on the fetching step motor |
| 2-16 | The fetching arm spring |

| | |
|---|---|
| 4 | Shoe cover storage feeding silo |
| 5 | Shoe cover |
| 2-10 | The left fetching arm |
| 2-11 | The right fetching arm |

| | |
|---|---|
| 4 | Shoe cover storage feeding silo |
| 5 | Shoe cover |
| 2-10 | The left fetching arm |
| 2-11 | The right fetching arm |

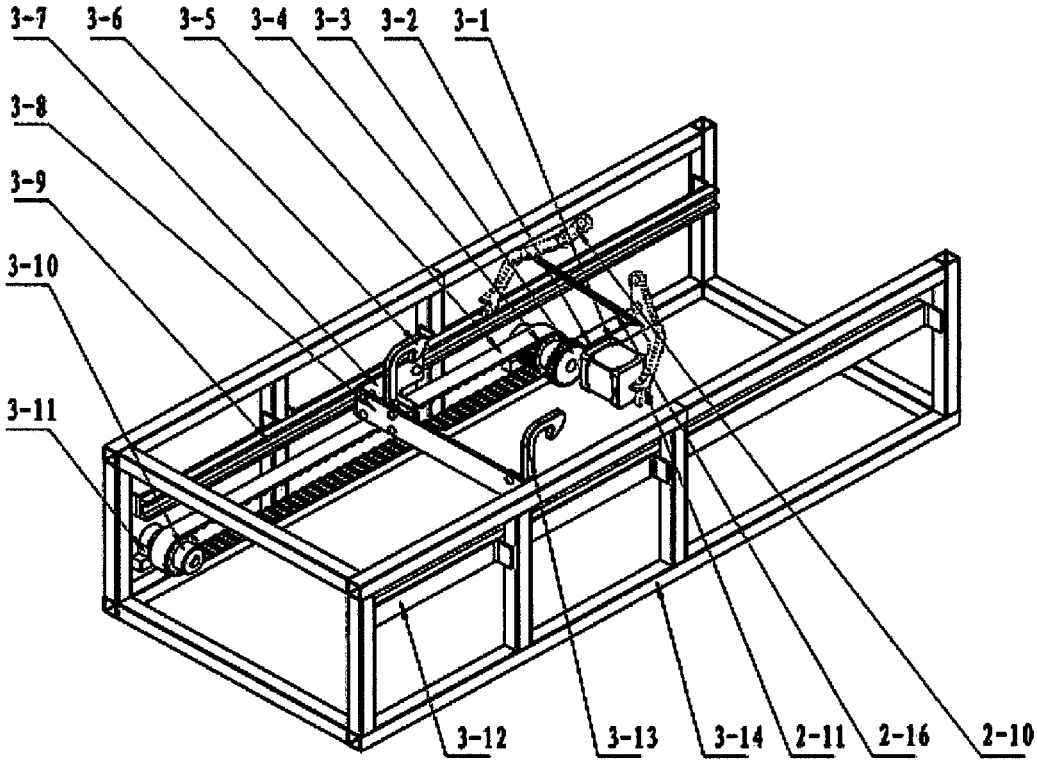

Figure 8

| | |
|---|---|
| 3-1 | The extension step motor |
| 3-2 | The axial end gear of extension motor |
| 3-3 | The driven gear |
| 3-4 | The wheel of synchronous drive belt |
| 3-5 | The synchronous drive belt |
| 3-6 | The left extension hook |
| 3-7 | The gripper of synchronous drive belt |
| 3-8 | The extension hook holder |
| 3-9 | The extension rail |
| 3-10 | The wheel of synchronous drive belt |
| 3-11 | The wheel holder of synchronous drive belt |
| 3-12 | The extension rail holder |
| 3-13 | The right stretching hook |
| 3-14 | The mounting rack |
| 2-11 | The right fetching hook |
| 2-16 | The fetching hook spring |
| 2-10 | The left fetching hook |

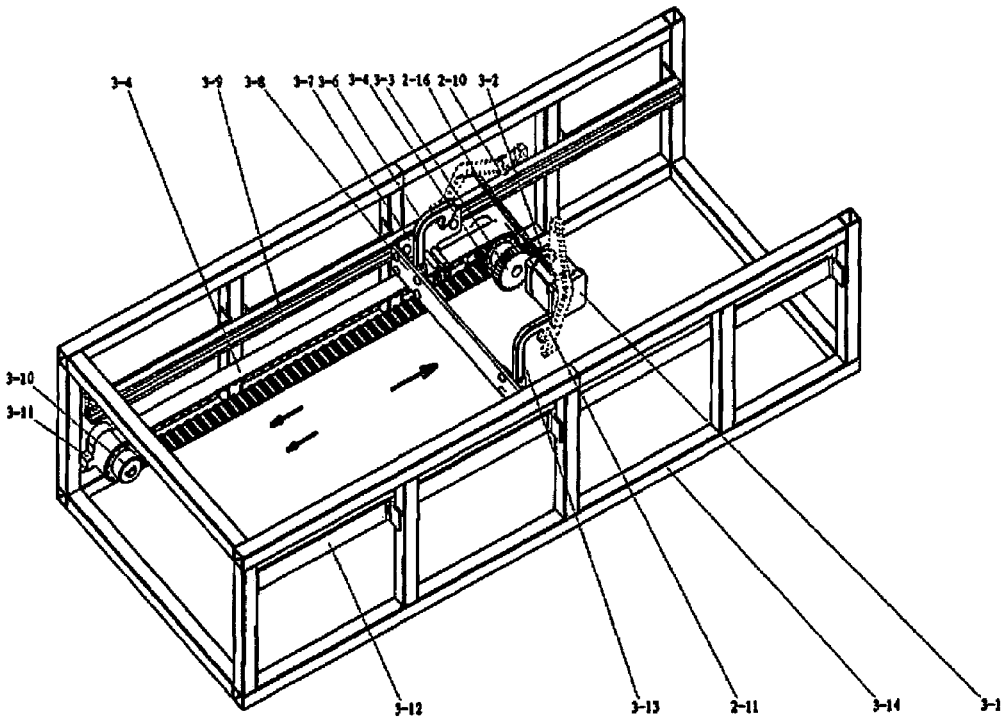

Figure 9

| | |
|---|---|
| 3-1 | The Extension step motor |
| 3-2 | The axial end gear of extension motor |
| 3-3 | The driven gear |
| 3-4 | The wheel of synchronous drive belt |
| 3-5 | The synchronous drive belt |
| 3-6 | The left extension hook |
| 3-7 | The gripper of synchronous drive belt |
| 3-8 | The extension hook holder |
| 3-9 | The extension rail |
| 3-10 | The wheel of synchronous drive belt |
| 3-11 | The wheel holder of synchronous drive belt |
| 3-12 | The extension rail holder |
| 3-13 | The right extension hook |
| 3-14 | The mounting rack |
| 2-11 | The right fetching hook |
| 2-16 | The fetching hook spring |
| 2-10 | The left fetching hook |

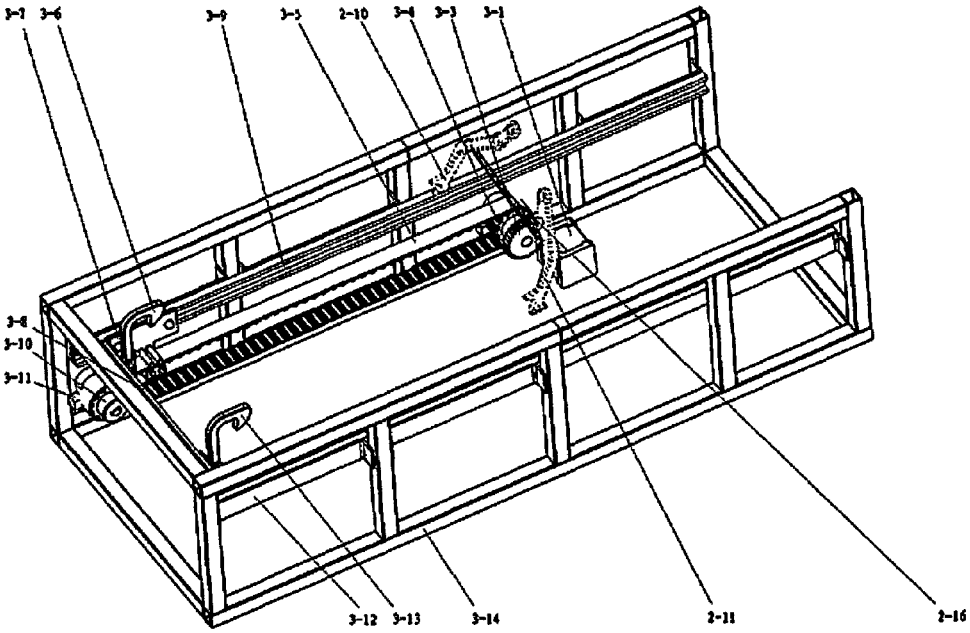

Figure 10

| | |
|---|---|
| 3-1 | Extension step motor |
| 3-2 | The axial end gear of extension motor |
| 3-3 | The driven gear |
| 3-4 | The wheel of synchronous drive belt |
| 3-5 | The synchronous drive belt |
| 3-6 | The left extension hook at the distal position |
| 3-7 | The gripper of synchronous drive belt |
| 3-8 | The extension hook holder |
| 3-9 | The extension rail |
| 3-10 | The wheel of synchronous drive belt |
| 3-11 | The wheel holder of synchronous drive belt |
| 3-12 | The extension rail holder |
| 3-13 | The right extension hook at the distal position |
| 3-14 | The mounting rack |
| 2-11 | The right fetching hook |
| 2-16 | The fetching hook spring |
| 2-10 | The left fetching hook |

| | |
|---|---|
| 4 | Shoe cover feeding silo |
| 4-1 | The weighing bar |
| 5 | The bottom view of the shoe cover is inside the feeding silo. |
| 5-1 | Stacked shoe covers (folded) in the feeding silo 4 |
| 5-2 | Shoe cover before folding |
| 5-3 | The folded view of a shoe cover |

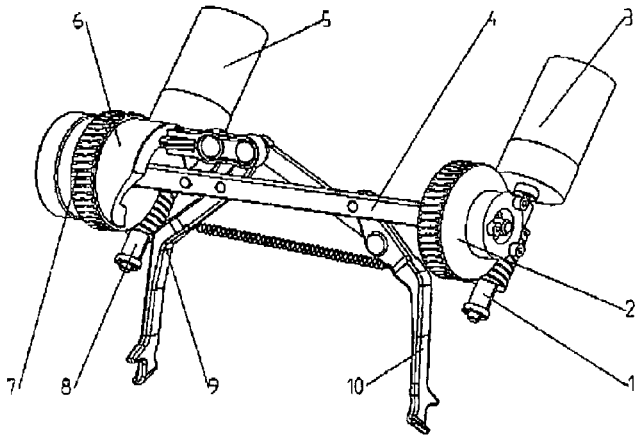

Figure 12 illustrates the electro-mechanical structure and mechanism for shoe cover fetching and stretching using the deceleration DC motor and worm transmission.

| | |
|---|---|
| 1 | Deceleration worm screw for shoe cover fetching |
| 2 | Deceleration worm gear for shoe cover fetching |
| 3 | Deceleration DC motor for shoe cover fetching |
| 4 | Rotating axial |
| 5 | Deceleration DC motor for shoe cover stretching |
| 6 | Cam for shoe cover stretching |
| 7 | Deceleration worm gear for shoe cover stretching |
| 8 | Deceleration worm screw for shoe cover stretching |
| 9 | The left shoe cover fetch hook |
| 10 | The right shoe cover fetch hook |

APPARATUS AND METHODS FOR AUTOMATIC DISPOSABLE SHOE COVER DISPENSE

This application claims the priority of U.S. provisional Patent Application of APPL No. 60/795,286, which was filed on Apr. 27, 2006 by the same inventors.

BACKGROUND OF THE INVENTION

1. Field of Invention

This invention relates to an automated system that dispenses disposable shoe covers to a user's feet for sanitation and/or environmental purposes. More specifically, the invention relates to the apparatus and methods for automatically dispensing of disposable shoe covers to a user's shoes (feet).

2. Discussion of the Related Art

Protective shoe covers have been widely used in health care settings such as surgical suites, intensive care units and cardiac catheter laboratories that require sterilization and control of cross contamination. Disposable shoe covers are also widely used in some manufacturing environments, including semiconductor and pharmaceutical industries that require "clean rooms" and sterile atmospheres to prevent dust and any other contaminates from human traffic.

Most disposable shoe covers available today require manual application, which is not only cumbersome to users, but also defeats the sterilization purpose in some circumstances. The previous disclosed shoe cover application device was not user friendly, therefore it did not gain wide acceptance. This invention presents an automatic shoe cover dispensing machine with an artificial intelligence capability that is able to provide users with a true hands-free application and reliable safety features.

SUMMARY OF THE INVENTION

The present invention encompasses a system and methods for automatically dispensing disposable shoe covers directly on a user's feet. The system includes the micro control unit, its embedded software and the control algorithm, the electro-mechanical operational apparatus and physical and biophysical sensors.

In one embodiment, the present invention contains a system including a micro control unit (MCU) and embedded software, photoelectric sensors, thermal-infrared sensors and position sensors, a real time digital shoe cover counter, digital display of the working status, alarm, voice activation, remote control, keypad and other command input means.

In one embodiment, the present invention includes a micro control unit (MCU) and embedded software to perform real time shoe cover counting and a reset function.

In one embodiment, the present invention contains a micro control unit (MCU), sensors and control algorithm that processes the information from the motion and position of the user's foot (feet).

In one embodiment, the present invention has a micro control unit (MCU) and embedded software processing all incoming information from various sensors to guide the operations and provide safety features to users.

In one embodiment, the present invention contains a micro control unit (MCU) and embedded software to control the electro-mechanical complex to prepare the shoe cover(s) and to direct operating units to apply the shoe cover to user's shoes automatically.

In one embodiment, it includes various sensors and transducers to collect physical and biophysical information i.e. position, location and blockage of the shoe cover working space in order to ensure proper operation.

In one embodiment, the present invention includes a micro control unit (MCU), embedded software, and a control algorithm to process all incoming information from several of sensors to assure safe operation and to prevent injury to users.

In another embodiment, the electro-mechanical complex includes a shoe cover fetching and stretching apparatus that fetches the shoe cover from the feeding silo and stretches the shoe cover to an extension-ready position.

In another embodiment, the electro-mechanical complex includes the shoe cover extension apparatus to place the shoe cover in the deployment position, of which shoe cover is ready to be dispensed (applied) on to a user's foot.

In another embodiment, the system includes a shoe cover feeding silo that keeps folded shoe covers neatly in stock. There are a top opening and a bottom opening of the feeding silo. The bottom opening allows the fetch arms to reach shoe cover in sequence and move it to a proper position for dispensing.

BRIEF DESCRIPTION OF THE SEVERAL VIEWS OF THE DRAWINGS

FIG. 1. Structural schematic of the automatic shoe cover-dispensing machine.

FIG. 4. Structure of the fetching and stretching module.

FIG. 8. The structure of the shoe cover extension module.

FIG. 9. The structure of the shoe cover extension module at a ready to the extending position.

FIG. 10. The structure of the shoe cover extension module at an extended position.

FIG. 12. Schematic that illustrates the shoe cover fetching and stretching modules using deceleration DC motor and worm transmission.

DESCRIPTION OF THE INVENTION

Reference is now made to FIG. 1, which figure illustrates an overview of the automatic shoe cover dispensing system in accordance with the present invention. The system includes the micro control unit (MCU) and embedded software, control panel[1], machine body, shoe cover fetching apparatus, shoe cover stretching apparatus[2], shoe cover extension apparatus[3] and shoe cover feeding silo[4]. The system could be performing in a single (FIG. 1*a*) or dual (FIG. 1*b*) dispensing capacity.

Figure 2:
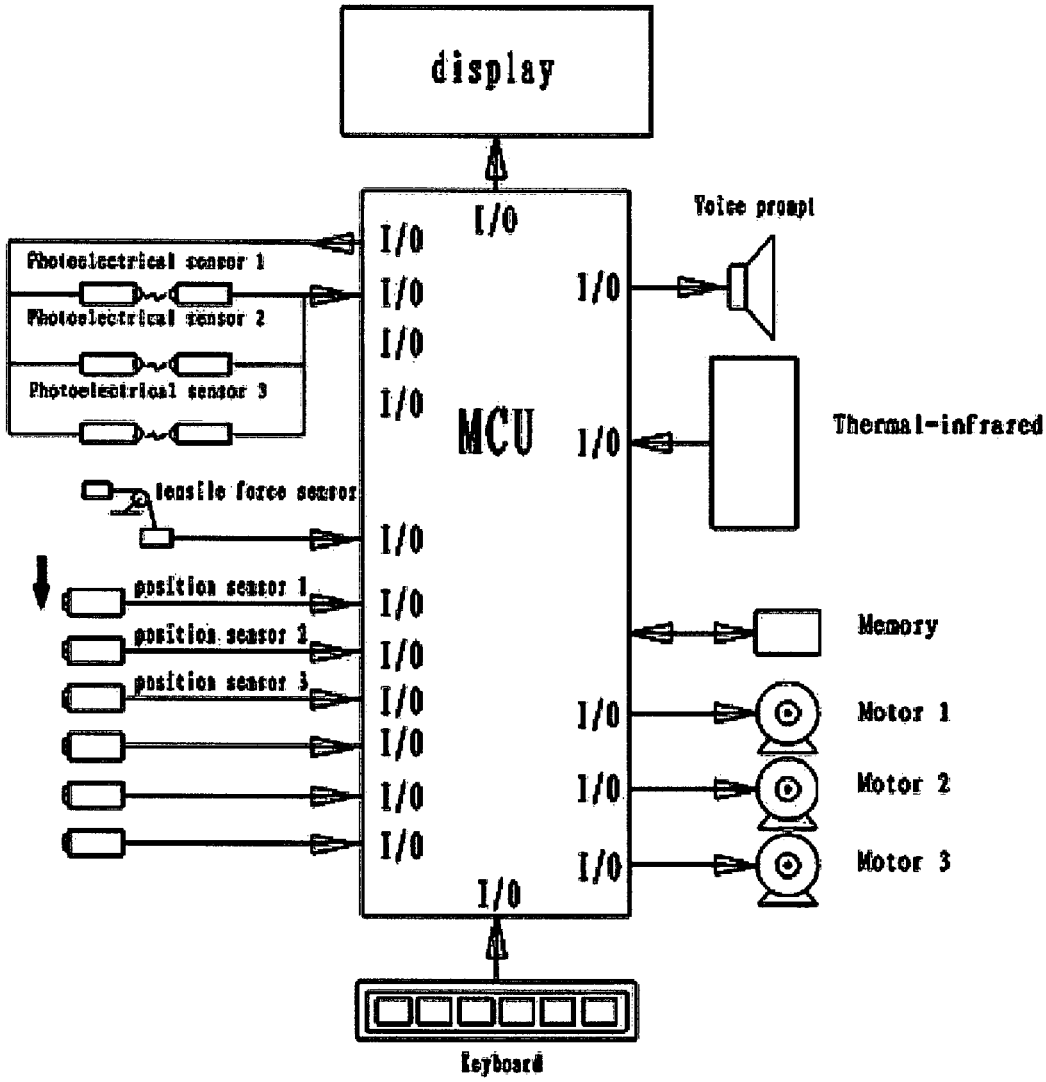
FIG. 2. The Control circuit architecture, the micro control unit (MCU) and hardware.
Figure 3:
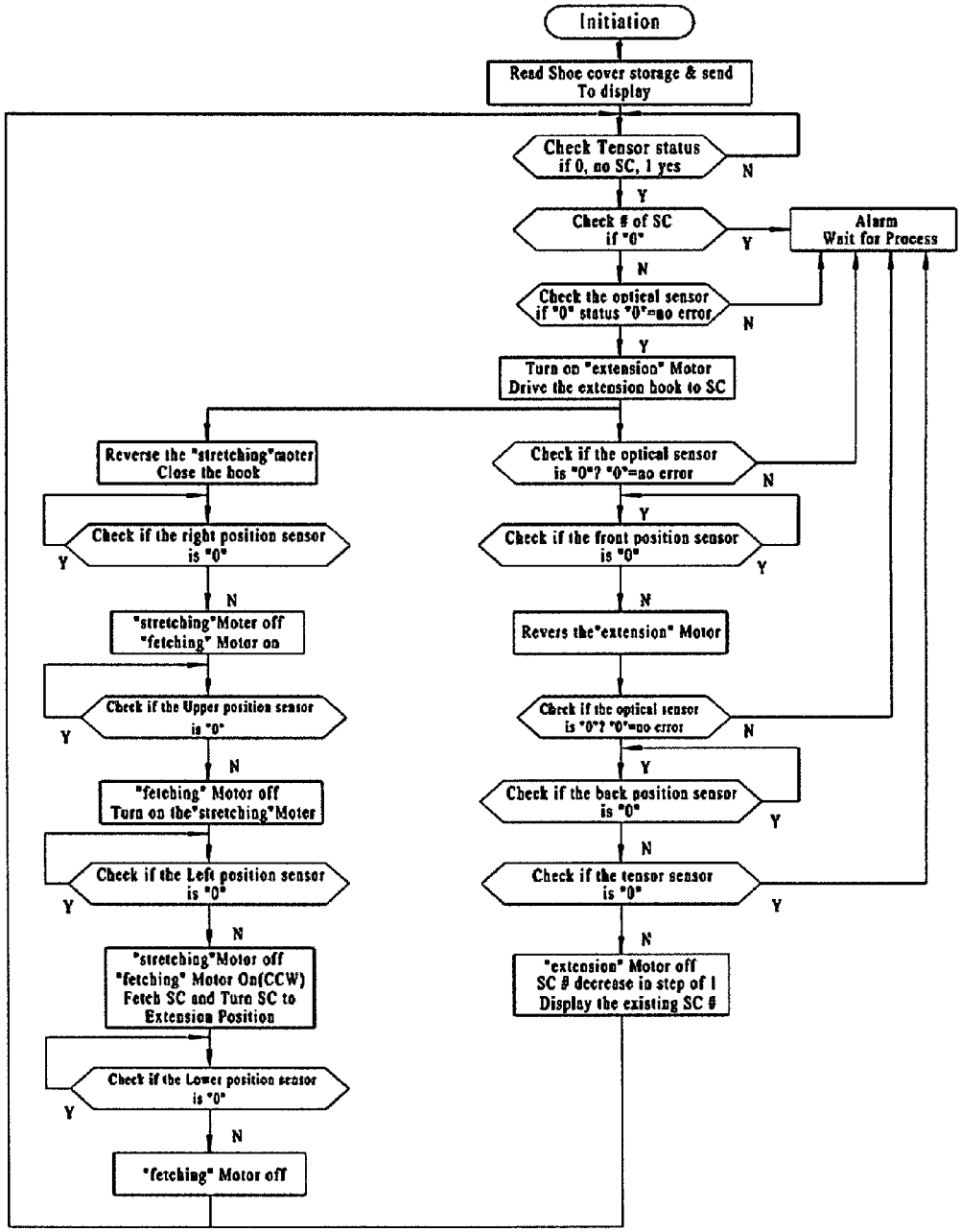
FIG. 3. The MCU logic control flow chart and the operational steps.

FIG. 2 is the schematic of the automatic shoe cover dispensing system that includes the micro control unit, electrical hardware, peripheral circuit. FIG. 3 is a flow diagram illustrates the control algorithm for automatic shoe cover dispensing operation. The following is a brief description of the operational steps: as the MCU receives electrical power, it starts its initiation process. It reads data from the memory and the number of shoe covers left in the feeding silo from the last operation that is displayed on the LED counter on the display panel. At same time, the MCU detects the status of the tensile force sensor. The tensile force sensor senses the status before and after removal of a shoe cover from the deployment space. The MCU determines if there is a shoe cover available in the deployment space by means of the tensile force sensor. If there is shoe cover in the deployment space, the MCU will continue detecting. If there is no shoe cover in the deployment (user's receiving) space, the MCU will issue commands to the control motors to perform a series of designated actions i.e. fetching, stretching and extension. In addition, according to the status control position from position sensors 1, 2 and 3, the motors perform turning and stop, (shoe cover) fetching, stretching and extension (loading) functions. To assure the user's safety, the MCU continuously detects the status of step motors and responds to any blockage in the deployment space during the motor's operation, which is detected by photoelectric and/or thermal-infrared sensors. If there is a blocking object detected in the deployment space, the MCU issues commands to stop the motors immediately. At the same time, the MCU sets the alarm off and displays a warning message. FIG. 3 is the logic flow chart that illustrates the detailed operational steps and the control algorithm for the machine operation.

Figure 5:
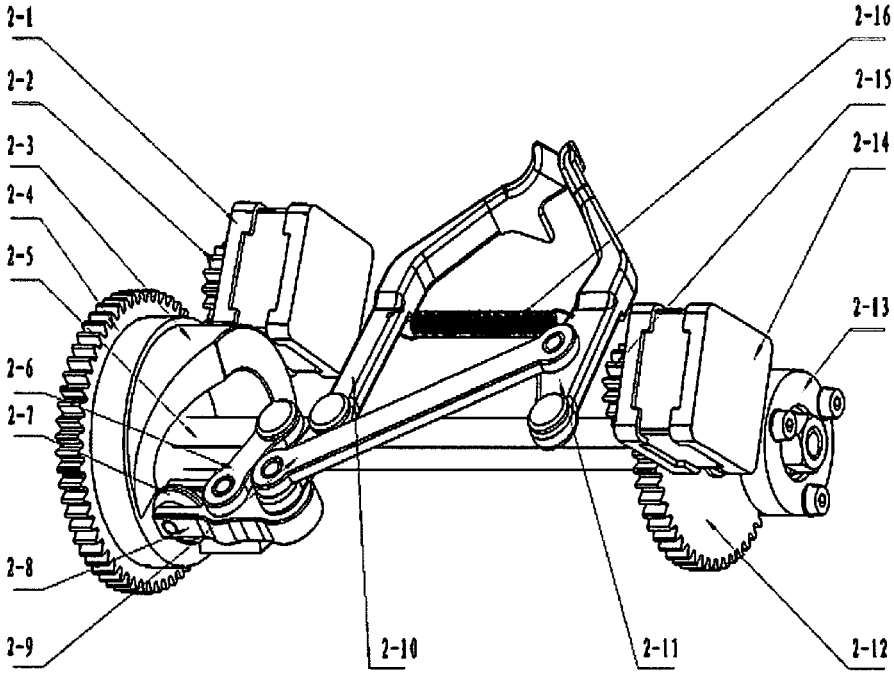
FIG. 5. Structure of the fetching and stretching modules at the ready position.
Figure 6:
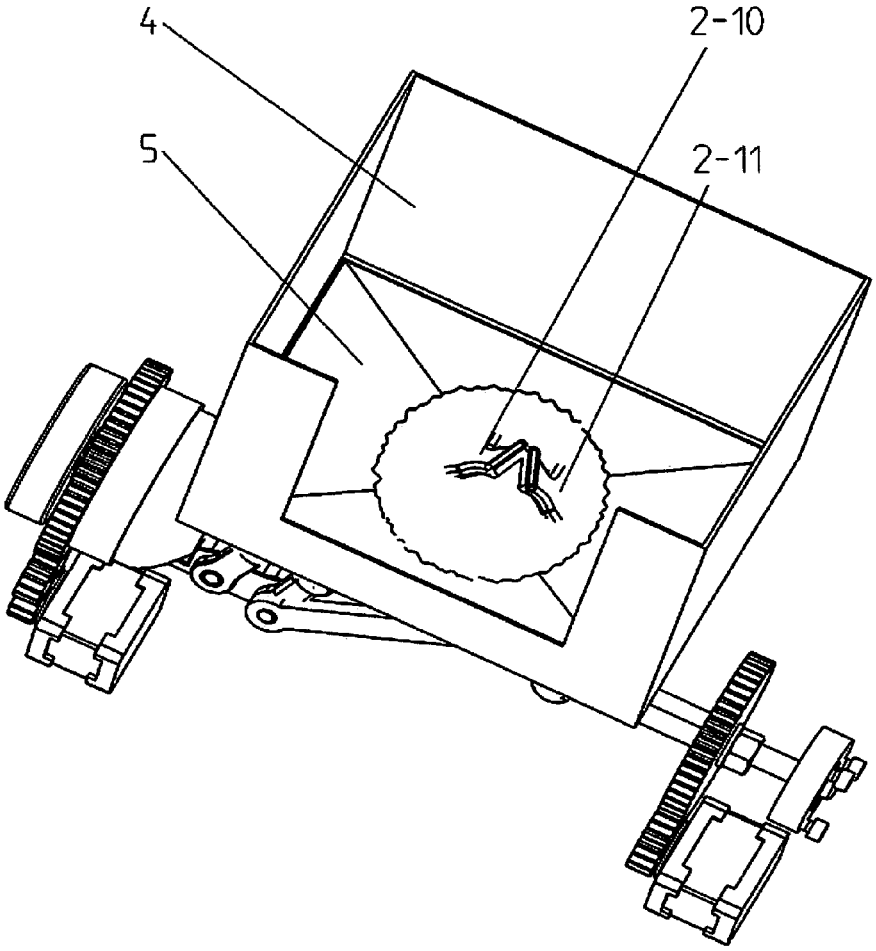
FIG. 6. Top view of the fetching and stretching modules when the fetching arms are inside the opening of the shoe cover.
Figure 7:
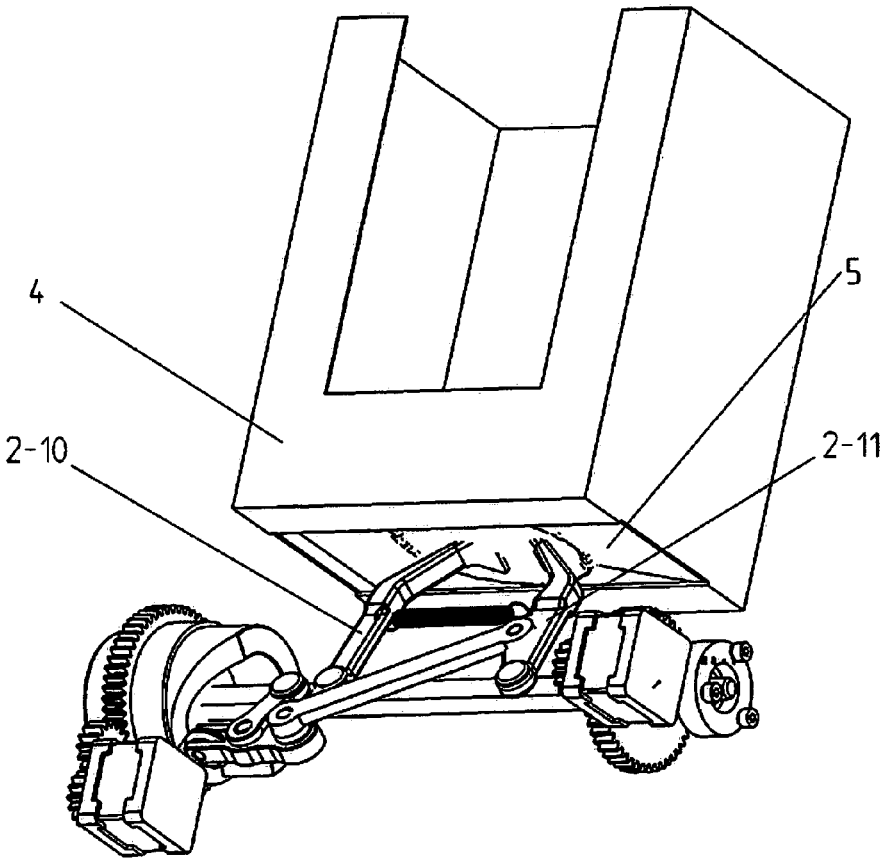
FIG. 7. Bottom view of the fetching and stretching module when the fetching arms are inside the opening of the shoe cover.

Reference is now made to FIGS. 4, 5 and 6, which figures illustrate the electro-mechanical structure and the operational mechanism of the automatic shoe cover fetching and stretching apparatus. The tensile force sensor sends out signal when a shoe cover has been removed, indicating that there is no shoe cover in the deployment (receiving) space. As soon as the MCU receives the signal from the sensors, it sends a series of Time Sequence Pulses (TSP) to turn on the Step Motor 2-14 to rotate clockwise. The Gear 2-15 on Step Motor 2-14 in turn to causes Gear 2-12 to turn counter-clockwise. As a result, the shoe cover fetching arms turn counter clockwise. The number of TSPs from the MCU determines the rotation angles of the step motor. The fetching and stretching functions are carried out by a moving unit, which is comprised of the fetching arms 2-10 and 2-11, Spring 2-16, the Long connecting rod 2-9, the Short connecting rod 2-6, the Wheel holder 2-8 and the Wheel 2-7. The moving unit is tightly coupled on the Circular pitch type Cam 2-3. When the Rotation axis 2-5 turns, the Wheel 2-7 moves horizontally following the change of the pitch slope, the Fetch arms close (move) inwardly. When the Fetching arm reaches the opening of the shoe cover feeding silo, the position sensor sends signals to the MCU; in turn, the MCU sends commands to stop Step Motor 2-14. As illustrated in FIG. 6 and FIG. 7 the Fetching arms make circular movements in order to move the shoe covers slightly to the place where the Fetching arms move into the opening of a shoe cover. When Step motor 2-14 stops, the MCU instructs Step Motor 2-1 to turn counter clockwise, via the Gear 2-2 and Gear 2-4 that is coupled to the Circular Pitch-type Cam 2-3; as a result, the Cam 2-3 turns counter clockwise. When the Cam 2-3 turns, the Pitch acts on the wheel 2-7 to make the wheel move horizontally following change of the pitch slope. The horizontal movement of the wheel causes the movement of the stretching apparatus (opening up of a shoe cover). The stretching apparatus is comprised of the Wheel 2-7, the Wheel holder 2-8, the Short connecting rod 2-6, the Long connecting rod 2-9, the Left Fetching arm 2-10, the Right fetching arm 2-11 and Spring 2-16. When the Cam 2-3 turns counter clockwise, the Fetching arms 2-10 and 2-11 move sideways to open up a shoe cover. When the Fetching arms reach the open position of a shoe cover, the MCU orders the Step motor 2-1 to stop. At the same time, the MCU orders Step Motor 2-14 to turn counter clockwise. The Gear 2-15 on the axis of the Step motor 2-14 causes the Rotation axis 2-5 and Gear 2-12 to rotate clockwise. Because the Fetching arms are connected, as the Rotating axis 2-5 turns clockwise, the shoe cover on the Fetching arms is pulled out. When the Fetching arms move downward to the extension position, the Step Motor 2-14 stops following on commands from the MCU, thus the shoe cover fetching step is completed.

Reference now is made to FIGS. 8, 9 and 10, which figures illustrate the automatic shoe cover extension apparatus and the mechanism of its operation. When the Step motor 2-14 turns on, the MCU also starts the Step motor 3-1 to rotate counter clockwise. A conventional electrical motor can also be used to substitute the Step motor 3-1. Since the Wheel of synchronous drive belt 3-4 and the Gear 3-3 are coaxial, when the Shaft-end gear 3-2 on the Step motor 3-1 drives the engaged Driven gear 3-3, in turn it drives the Synchronous drive belt 3-5 to move inward (toward proximal) along the guiding rail 3-9. The Extension (pull) hooks 3-6 and 3-13 have a mechanical connection with the Synchronous drive belt 3-5 via the Extension hook holder 3-8 and the Gripper 3-7, therefore, the Extension Hooks 3-6 and 3-13 follow the Synchronous drive belt 3-5 advancing toward the proximal side (indicated as a single arrow). When the Extension hooks move to the extension ready position, according to the Time Sequence Pulses (TSP) sent out by the MCU, the Fetching arms rotate to the lower position and are ready for extension (see FIG. 9). When the Extension hooks enter the opening of a shoe cover, the position sensors send out signals to MCU. As the MCU receives the signals from the position sensor, it initiates the Step motor 3-1 to rotate counter clockwise, therefore, the Extension hooks start to advance distally (as indicated by double arrows). Since the opening of the shoe cover is hold by both the Extension hooks and the Fetching arms, the shoe cover is extended up longitudinally following an outward movement from the Extension hooks. When the Extension hooks reach the maximum distance, (see FIG. 10), the outside position sensor signals the MCU. In turn the MCU sends commands to the Step motor 3-1 to stop its rotation. At this point, the shoe cover reaches the ready position for dispensing. As soon as the shoe cover is deployed to a user's foot and moved away from the deployment (receiving space), the MCU and its program are set for the next work cycle.

Figure 11:
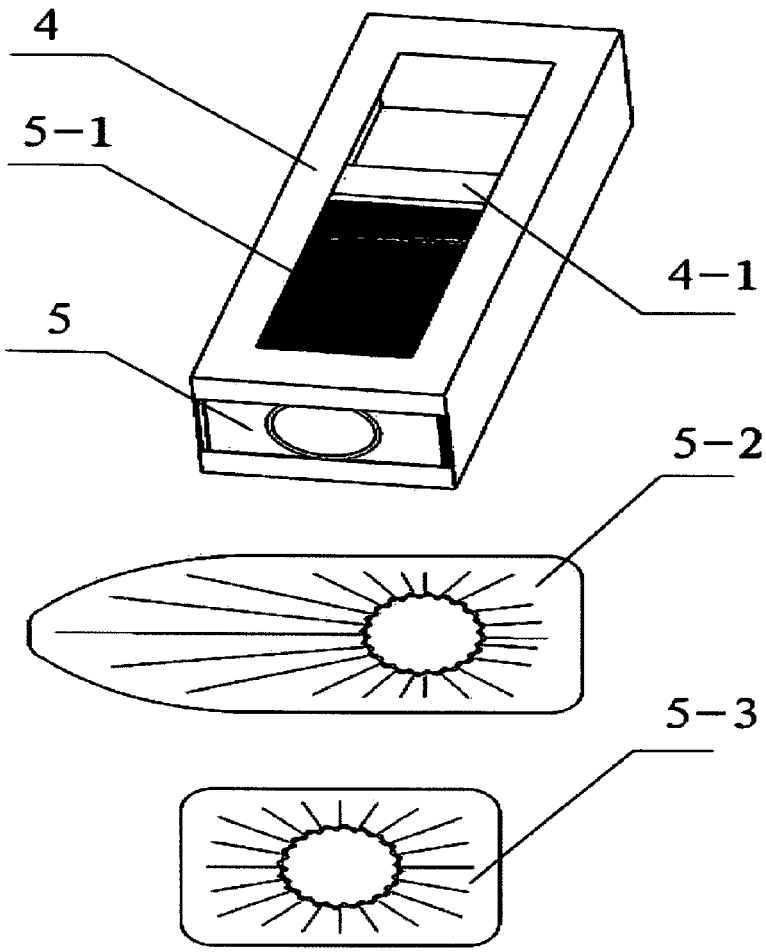
FIG. 11. Schematic that illustrates the shoe cover feeding silo and shoe cover folding.

Reference now is made to FIG. 11, which figure illustrates the structure and working mechanism of the shoe cover feeding silo, an accessory of the automatic shoe cover dispenser machine. The folded shoe cover feeding silo could be a rectangular or polygon shaped cardboard silo, which has a top opening and a bottom opening. The bottom opening of the feeding silo allows the Fetching arms to move in and out to fetch and pull the shoe cover out from the silo. 5-2 is a sketch of a shoe cover and 5-3 is a folded shoe cover. The shoe cover could be made of different types of fabric or of plastic sheet. The shoe cover is folded as The bottom opening of the feeding silo 4 is narrower than the width of folded shoe cover (see sketch 5) to assure that large numbers of shoe covers can be stacked neatly inside the feeding silo 4 (see sketch 5-1) and prevent them falling out, as is illustrated in FIG. 11. There is a weight bar 4-1 placed on the top the folded shoe covers. The main function of the weight bar is to hold down the shoe covers and to assure that the next shoe cover will be placed in the right position for the next cycle.

The invention claimed is:

1. An automatic shoe cover dispensing system, comprising an electro-mechanical complex that includes a shoe cover fetching module, a shoe cover stretching module, and a shoe cover extension module to perform shoe cover fetching, stretching and extension functions in order to prepare a disposable shoe cover to be applied to a user's foot under guidance of commands from a micro control unit (MCU) and embedded software programs; wherein said electro-mechanical complex comprises said micro control unit and embedded software programs, an electronic hardware and electrical circuitry, a control algorithm that guides the automatic shoe cover dispensing function, and a set of physical and biophysical sensors to provide operational and safety guidance, wherein said sensors include tensile force sensors, photoelectric sensors, position sensors and thermal-infrared sensors.

2. The automatic shoe cover dispensing system of claim 1, wherein the physical and biophysical sensors comprise functions that acquire physical signals from said sensors and transmit the acquired signals to the MCU for processing and executing the operational steps according to said control algorithm.

3. A method and control algorithm for automatically executing commands from the MCU and performing the shoe cover dispensing functions of said system according to claim 1 comprising steps of:

(a) initiating the shoe cover dispensing system and detecting a working status of deployment space;

(b) performing the shoe cover fetching function;

(c) performing the shoe cover stretching function;

(d) performing the shoe cover extension function;

(e) performing the safety function by sensing a blockage in the deployment space, wherein said blockage includes human body parts and physical objects;

(f) performing the safety function by stopping an electro-mechanical operation, setting off an alarm, and displaying a warning message; and (g) performing a reset function as soon as said blockage is removed.

4. The automatic shoe cover dispensing system of claim 1, wherein the special electro-mechanical complex is energized by step motors or DC servomotor that are digitally controlled by the commands from MCU and the embedded programs.

5. The automatic shoe cover dispensing system of claim 1, wherein the electro-mechanical complex performs the shoe cover extension movements that are driven by a synchronous driving belt mechanism.

6. The automatic shoe cover dispensing system of claim 1, comprising a special worm transmission having a worm pair that drives a fetching-arm directly via a circular movement, said worm pair being driven by step motors or DC servomotors to assure smooth, precision and low-noise operation.

7. The automatic shoe cover dispensing system of claim 1, wherein said stretching module performs stretching movements of opening and closing said shoe cover, said module using step motors or a DC deceleration servomotor via a worm transmission.

8. The automatic shoe cover dispensing system of claim 7, wherein the stretching movements are digitally controlled by a custom-designed command from the MCU.

9. The automatic shoe cover dispensing system of claim 1, wherein the electro-mechanical complex comprises fetching arms, extension hooks, step motors, synchronous drive belt worm, circular pitch-type cam, gears, axis and connecting rods.

10. The automatic shoe cover dispensing system of claim 1, further comprising means for displaying and alarming with respect to sensing and counting a quantity of shoe covers in real time and relaying to the MCU for a replenishment decision.

11. The automatic shoe cover dispensing system of claim 1, further comprising the means for counting number of shoe covers, displaying said number digitally, and displaying a warning message and setting off the alarm in real time so to provide feedback to the MCU for a replenishment decision when the number passes a predetermined number.

12. The automatic shoe cover dispensing system of claim 1, further comprising a signal sensing and processing unit that is capable of recognizing and accepting human commands including voice, touch screen commands, or via keypad.

13. The automatic shoe cover dispensing system of claim 1, wherein the system is expanded to a dual system that is capable of dispensing shoe covers to two feet sequentially or simultaneously of a user.

* * * * *